US009140252B2

(12) United States Patent
Miyazaki et al.

(10) Patent No.: US 9,140,252 B2
(45) Date of Patent: Sep. 22, 2015

(54) FLUID TRANSPORTER

(75) Inventors: Hajime Miyazaki, Matsumoto (JP); Kazuo Kawasumi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 235 days.

(21) Appl. No.: 13/155,695

(22) Filed: Jun. 8, 2011

(65) Prior Publication Data

US 2011/0305588 A1 Dec. 15, 2011

(30) Foreign Application Priority Data

Jun. 9, 2010 (JP) ..... 2010-131740

(51) Int. Cl.
*F04B 43/14* (2006.01)
*F04B 43/08* (2006.01)

(52) U.S. Cl.
CPC ..... *F04B 43/14* (2013.01); *F04B 43/082* (2013.01)

(58) Field of Classification Search
CPC .... F04B 43/12; F04B 43/123; F04B 43/1223; F04B 43/14; F04B 43/1276; F04B 43/1261; F04B 43/08; F04B 43/082
USPC ..... 417/477.1, 477.3, 474, 477.2, 477.9, 417/477.12
See application file for complete search history.

(56) References Cited

U.S. PATENT DOCUMENTS 1,982,603 A * 11/1934 Barbaron ..... 74/55
2,804,023 A * 8/1957 Lee ..... 417/477.7
2,885,966 A * 5/1959 Ford ..... 417/477.7
3,216,362 A * 11/1965 Hewko ..... 417/475
3,366,071 A * 1/1968 Dutler ..... 417/477.6
3,829,251 A * 8/1974 Schwing ..... 417/477.8
4,479,797 A * 10/1984 Kobayashi et al. ..... 604/153
4,586,883 A * 5/1986 Sumner ..... 417/477.12
5,083,908 A 1/1992 Gagnebin et al.
5,110,270 A * 5/1992 Morrick ..... 417/477.7
5,980,490 A * 11/1999 Tsoukalis ..... 604/151
2007/0154336 A1* 7/2007 Miyazaki et al. ..... 417/474
2008/0131300 A1* 6/2008 Junod et al. ..... 417/476
2008/0138222 A1* 6/2008 Miyazaki et al. ..... 417/474
2009/0060755 A1* 3/2009 Miyazaki ..... 417/212
2009/0208350 A1* 8/2009 Miyazaki et al. ..... 417/316
2010/0047099 A1* 2/2010 Miyazaki et al. ..... 417/477.6
2010/0143168 A1* 6/2010 Miyazaki et al. ..... 417/412
2010/0296955 A1* 11/2010 Wolff ..... 417/477.3

FOREIGN PATENT DOCUMENTS

DE 3413437 4/1985
JP 40-025643 9/1965
JP 61-197283 12/1986
JP 02280763 11/1990
JP 2001515557 A 9/2001
WO 9734084 A1 9/1997

* cited by examiner

*Primary Examiner* — Charles Freay
*Assistant Examiner* — Lilya Pekarskaya
(74) *Attorney, Agent, or Firm* — Workman Nydegger

(57) ABSTRACT

A fluid transporter includes: a rotor; a fluid delivery channel which has a groove having a circular-arc shape around a rotation axis of the rotor and disposed on a surface of a channel frame opposed to the rotor, and a sheet-shaped elastic member sealing an opening of the groove; and a plurality of pressing members disposed between the rotor and the elastic member to sequentially and repeatedly open and close the delivery channel from the upstream side to the downstream side by deforming the elastic member in accordance with the rotation of the rotor.

9 Claims, 11 Drawing Sheets

FLUID TRANSPORTER

BACKGROUND

1. Technical Field

The present invention relates to a fluid transporter which transports a small quantity of fluid at low speed.

2. Related Art

A peristaltic pump is known as a device for transporting liquid at low speed. Examples of the peristaltic pump involve a type which delivers liquid by pressing an elastic tube as a fluid delivery channel from the upstream side to the downstream side using a plurality of fingers (for example, see JP-T-2001-515557).

Another example of the peristaltic pump transports liquid by pressing a tube from the upstream side to the downstream side using a plurality of rollers attached to a rotor (for example, see JP-A-2-280763).

These types of pumps are called tube pumps in view of the structure which transports liquid by pressing the elastic tube.

According to the tube pumps disclosed in JP-T-2001-515557 and JP-A-2-280763 each of which delivers liquid by pressing the tube, variations in the inside diameter of the tube in manufacture directly affects the accuracy of the delivery amount of liquid when a small amount of the liquid is transported. However, sufficient accuracy of the inside diameter of the elastic tube in these tube pumps is difficult to be secured.

SUMMARY

It is an advantage of some aspects of the invention to solve at least a part of the aforementioned problems and the invention can be implemented as the following forms or application examples.

APPLICATION EXAMPLE 1

This application example of the invention is directed to a fluid transporter which includes: a rotor; a fluid delivery channel which has a groove having a circular-arc shape on a concentric circle around a rotation axis of the rotor and disposed on a surface of a channel frame, and a sheet-shaped elastic member sealing an opening of the groove in the rotor direction; and a plurality of pressing members disposed between the rotor and the elastic member to sequentially and repeatedly open and close the delivery channel from the upstream side to the downstream side by deforming the elastic member in accordance with the rotation of the rotor.

According to this application example of the invention, the delivery channel has the groove and the sheet-shaped elastic member formed on the channel frame. In this case, the accuracy of the cross-sectional area of the delivery channel becomes higher than the accuracy of the inside diameter of an elastic tube in related art based on the fact that the groove can be produced with high accuracy by injection molding or other methods and the fact that the sheet-shaped elastic member has little effect on the dimensional variations of the delivery channel. Thus, the variations of the delivery amount of fluid caused by the variations in the cross-sectional area of the delivery channel decrease. Accordingly, the accuracy of the delivery amount of fluid improves.

APPLICATION EXAMPLE 2

It is preferable that the fluid transporter of the above application example further includes a pressing portion provided on each of the plural pressing members to press the elastic member. In this case, each of the pressing portions has a shape similar to the cross-sectional shape of the groove in the direction perpendicular to the fluid flowing direction.

When the pressing portions of the pressing members are thus shaped, the delivery channel can be securely closed.

APPLICATION EXAMPLE 3

It is preferable that each of the pressing portions of the fluid transporter of the above application example has elasticity.

When each of the pressing portions of the pressing members has elasticity, the shapes of the pressing portions can easily follow the shape of the groove at the time of pressing the elastic member. Thus, the delivery channel can be further securely closed.

APPLICATION EXAMPLE 4

It is preferable that each of the pressing portions of the fluid transporter of the above application example has a fringe portion which presses the peripheral surface of the groove to which the elastic member is fixed.

In closing the delivery channel by the pressing members, there is a possibility that an extremely small space is produced on a fixing boundary between the groove and the elastic member and is not completely closed. In this case, a predetermined delivery amount is difficult to be secured due to insufficient closure of the delivery channel. When the fringe portions are provided as in this application example, however, the fixing boundary can be sufficiently closed. Thus, the predetermined delivery amount can be secured.

APPLICATION EXAMPLE 5

It is preferable that the cross-sectional shape of a channel wall of the groove in the direction perpendicular to the fluid flowing direction is a circular-arc shape in the fluid transporter of the above application example.

The shape of the groove is not particularly limited but may be quadrangular or trapezoidal, for example. The groove shape can be simplified when the groove is substantially circular-arc-shaped. In case of the quadrangular or trapezoidal groove, corners are produced at the crossing positions of the respective sides. In this case, extremely small clearances are produced at the corners at the time of closure of the delivery channel by using the elastic member. When the channel wall is substantially circular-arc-shaped, no corner is produced. Thus, the delivery channel can be more securely closed with no clearance produced.

APPLICATION EXAMPLE 6

It is preferable that the delivery channel of the fluid transporter of the above application example is so shaped that the groove and the elastic member become substantially symmetric with respect to the peripheral surface of the groove to which the elastic member is fixed.

According to this structure, the delivery channel is defined by the groove and the elastic member provided with a recess having a shape substantially similar to the cross-sectional shape of the groove. In such a structure which includes a simple sheet-shaped elastic member, the pressing members press the elastic member in such a manner as to expand the elastic member at the time of pressing the elastic member for closure of the delivery channel. In this case, the pressing forces of the pressing members increase. However, when the elastic member has the same shape as that of the groove, the amount of expansion of the elastic member decreases, whereby the delivery channel can be securely closed even by small pressing forces of the pressing members. In addition, the durability of the elastic member improves.

APPLICATION EXAMPLE 7

It is preferable that the delivery channel of the fluid transporter of the above application example is provided on the outer circumferential side surface of the channel frame.

According to this structure, the groove can be easily formed. Moreover, the work for fixing the elastic member can be facilitated.

APPLICATION EXAMPLE 8

It is preferable that the channel frame of the fluid transporter of the above application example has the delivery channel, and a fluid inlet channel and a fluid outlet channel penetrating the channel wall of the groove. In this case, the inlet channel is disposed on the upstream part of the delivery channel, and the outlet channel is disposed on the downstream part of the delivery channel.

According to this structure, the inlet channel and the outlet channel formed as holes in the channel frame have more simplified structure than that of the inlet channel and the outlet channel provided on the extending direction of the circular-arc-shaped delivery channel. Moreover, when the fluid to be transported is a liquid medicine injected into a living body, the delivery channel, the inlet channel and the outlet channel can be formed exclusively within the channel frame and the channel frame including the components in contact with the liquid medicine can be replaced with a new channel frame, safety increases, and the running costs decrease because the other components can be repeatedly used.

APPLICATION EXAMPLE 9

It is preferable that the rotor of the fluid transporter of the above application example is a cam. In this case, the plural pressing members are fingers radially disposed in directions from the rotation axis of the cam and pressed by the cam.

According to this structure, fluid can be transported by utilizing the peristaltic movement of the fingers. Moreover, the structure which includes the fingers pressing the elastic member in the vertical direction decreases the rotation loads of the cam. In addition, the components can be made compact, contributing to size reduction of the entire fluid transporter.

BRIEF DESCRIPTION OF THE DRAWINGS

The invention will be described with reference to the accompanying drawings, wherein like numbers reference like elements.

FIGS. 5A and 5B illustrate a fluid transporter according to a second embodiment, wherein: FIG. 5A is a partial cross-sectional view showing a cross section taken along the line A-P1-A in FIG. 1; and FIG. 5B is a perspective view showing a part of a finger.

FIGS. 11A and 11B illustrate a finger according to a fifth embodiment, wherein: FIG. 11A is a front view in an example 1; and FIG. 11B is a front view in an example 2.

DESCRIPTION OF EXEMPLARY EMBODIMENTS

Exemplary embodiments according to the invention are hereinafter described with reference to the drawings.

The figures referred to herein are schematic figures whose reduction scales for components and parts in the vertical and horizontal directions are different from the actual scales for convenience of explanation. In the following description of the embodiments, a fluid transporter as a device which injects a small quantity of a liquid medicine into a living body at low speed will be discussed.

First Embodiment

Figure 1:
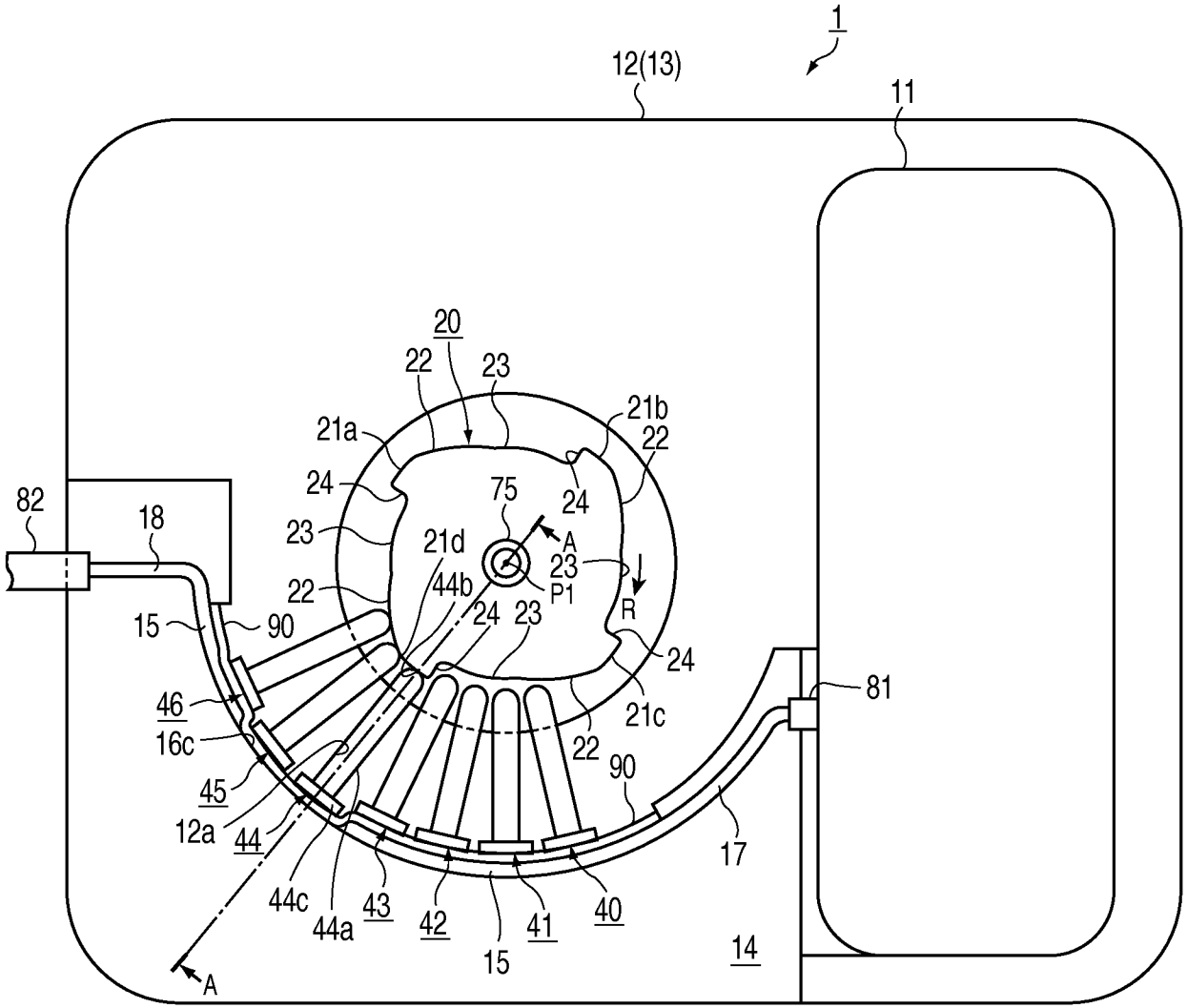
FIG. 1 is a plan view illustrating a part of a fluid transporter according to a first embodiment.
Figure 2A:
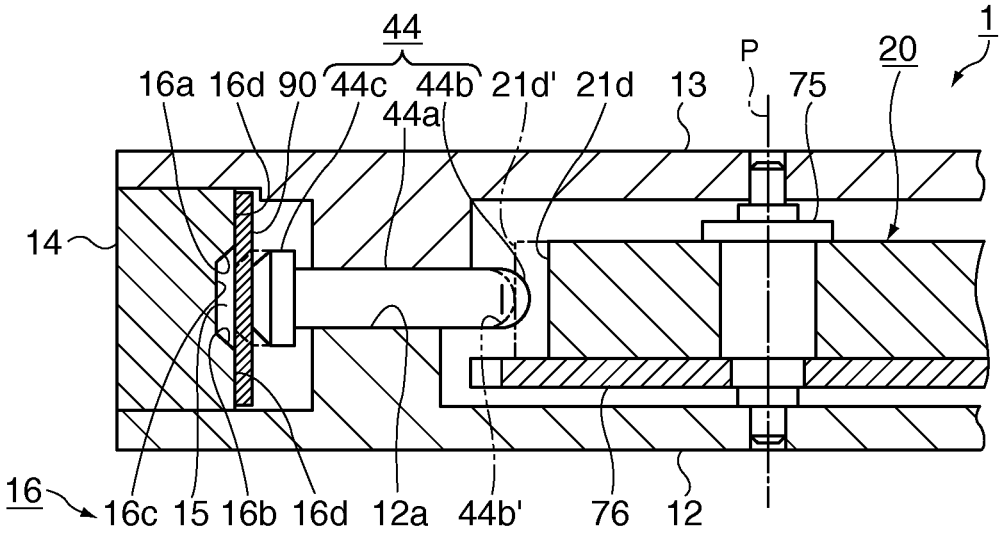
FIG. 2A is a partial cross-sectional view showing a cross section taken along a line A-P1-A in FIG. 1.
Figure 2B:
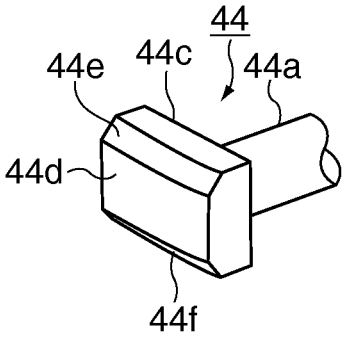
FIG. 2B is a perspective view showing a part of a finger.

FIG. 1 is a plan view illustrating a part of a fluid transporter according to a first embodiment. FIG. 2A is a partial cross-sectional view illustrating a cross section taken along a line A-P1-A in FIG. 1. FIG. 2B is a perspective view illustrating a part of a finger. FIG. 1 is a drawing showing functions of the chief functional elements in perspective. As illustrated in FIGS. 1, 2A and 2B, a fluid transporter 1 includes a reservoir 11 for storing a liquid medicine, a cam 20 as a rotor, a channel frame 14 where a fluid delivery channel 15 is provided, and a plurality of fingers 40 through 46 as pressing members disposed between the delivery channel 15 and the cam 20 and arranged radially at equal intervals in directions from a rotation axis P1 of the cam 20.

The fluid transporter 1 further includes a driving device as a driving source, a transmission mechanism which transmits the drive of the driving device to the cam 20 at a predetermined reduction ratio, a control circuit which controls the driving device, and a small battery as a power source for supplying power to the control circuit, each of which components is not shown in the figure.

The reservoir 11 is an elastic resin container whose volume is variable in accordance with the amount of fluid to be stored, and communicates with the delivery channel 15 via a connection tube 81.

The cam 20 is a disk-shaped component having a cam surface on the outer circumferential side surface, where finger pressing surfaces 21*a* through 21*d* are provided on the outermost circumference. The respective finger pressing surfaces 21*a* through 21*d* are disposed on a concentric circle at the equal distance from the rotation axis P1. Each pair of the finger pressing surface 21*a* and the finger pressing surface 21*b*, the finger pressing surface 21*b* and the finger pressing surface 21*c*, the finger pressing surface 21*c* and the finger pressing surface 21*d*, and the finger pressing surface 21*d* and the finger pressing surface 21*a* are so constructed as to have the same pitch in the circumferential direction and the same external shape.

The cam 20 is rotatably supported by a first device frame 12 and a second device frame 13 in such a condition as to be fixed to a cam shaft 75 to which a cam gear 76 is also secured (see FIG. 2A). The cam shaft 75 transmits the rotation of the driving device to the cam 20 via the cam gear 76 to rotate the cam 20 around the rotation axis P1 in a direction indicated by an arrow R (see FIG. 1).

Each of the finger pressing surfaces 21*a* through 21*d* is continuously formed from a finger pressing slope 22 and a circular-arc-shaped portion 23 positioned on a concentric circle around the rotation axis P1. The respective circular-arc-shaped portions 23 are disposed in such positions as not to press the fingers 40 through 46.

One end of each of the finger pressing surfaces 21*a*, 21*b*, 21*c*, and 21*d* is connected with the corresponding circular-arc-shaped portion 23 by a linear portion 24 extended from the rotation axis P1.

The fluid delivery channel 15 provided on the outer circumferential side surface of the channel frame 14 has a circular-arc-shaped groove 16 on a concentric circle around the rotation axis P1 of the cam 20, and a sheet-shaped elastic member 90 which seals the opening of the groove 16 on the side opposed to the cam 20. The groove 16 is defined by a channel wall 16*c* and slopes 16*a* and 16*b* to form a trapezoidal shape in this embodiment. The end of the delivery channel 15 in the extending direction thereof on the reservoir 11 side communicates with an inlet channel 17, while the other end of the delivery channel 15 communicates with an outlet channel 18. In the following description, the inlet channel side corresponds to the upstream side, and the outlet channel side corresponds to the downstream side.

The elastic member 90 fixed to a peripheral surface 16*d* of the groove 16 tightly closes the opening of the groove 16 on the cam 20 side. The delivery channel 15 is constituted by the groove 16 and the elastic member 90.

The elastic member 90 has elasticity sufficient for deforming into contact with the channel wall 16*c* and the slopes 16*a* and 16*b* by the press of the fingers 40 through 46. The elastic force of the elastic member 90 is also large enough to shift the fingers 40 through 46 in the directions toward the rotation axis P1 for opening the delivery channel 15 when the pressing conditions of the fingers 40 through 46 are released in accordance with the rotation of the cam 20.

As illustrated in FIG. 1, the delivery channel 15 extends at least through the range from the pressing position of the finger 40 located at the upstream end to the pressing position of the finger 46 located at the downstream end. The upstream end and the downstream end of the delivery channel 15 communicate with the inlet channel 17 and the outlet channel 18, respectively.

Each of the inlet channel 17 and the outlet channel 18 is a groove formed from the upper surface of the channel frame 14 and closed by the second device frame 13. The inlet channel 17 and the outlet channel 18 may be closed by a component other than the second device frame 13. The inlet channel 17 communicates with the reservoir 11 via the connection tube 81. On the other hand, the outlet channel 18 is guided to the outside of the fluid transporter 1 via a connection tube 82. In case of injection of a liquid medicine into a living body, an injection tube (not shown) is further inserted into the connection tube 82.

The configurations of the fingers 40 through 46 are now explained in conjunction with FIGS. 2A and 2B. In the following description, only the finger 44 is touched upon as an example of the fingers 40 through 46 having the same shape. FIG. 2A shows the condition in which the finger 44 does not press the elastic member 90, that is, the condition in which the delivery channel 15 is opened. The finger 44 has a bar-shaped shaft portion 44*a*, a pressing portion 44*c* disposed on the elastic member 90 side of the shaft portion 44*a*, and a cam contact portion 44*b* disposed on the cam 20 side of the shaft portion 44*a*. The cross-sectional shape of the shaft portion 44*a* is quadrangular or circular. The cam contact portion 44*b* is rounded as a smooth surface.

The cross-sectional shape of the shaft portion 44*a* may be either circular or quadrangular. When the shaft portion 44*a* has a quadrangular cross section, the cam contact portion 44*b* is smoothly rounded into a substantially circular shape in the plan view.

As illustrated in FIG. 2B, the pressing portion 44*c* is a substantially quadrangular fringe-shaped component which has a pressing surface 44*d* disposed on a circle concentric with the channel wall 16*c*, and slopes 44*e* and 44*f* having the same angles as those of the slopes 16*a* and 16*b*, respectively. Thus, the pressing portion 44*c* (pressing surface 44*d* and slopes 44*e* and 44*f*) is so configured as to follow the shape of the delivery channel 15 (channel wall 16*c* and slopes 16*a* and 16*b*), i.e., a shape substantially similar to the shape of the delivery channel 15.

The fingers 40 through 46 are attached to finger attachment grooves 12*a* formed in the first device frame 12, and are held in such a manner as to project and withdraw in the axial direction with the upper areas of the fingers 40 through 46 covered by the second device frame 13. The fingers 40 through 46 may be held by a dedicated holding component other than the second device frame 13.

The closure of the delivery channel 15 is now explained with reference to FIG. 3.

Figure 3:
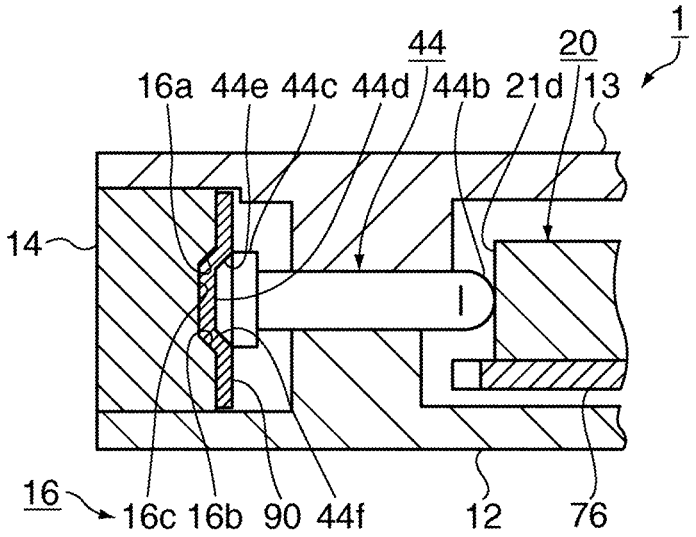
FIG. 3 is a partial cross-sectional view illustrating a closed condition of a delivery channel according to the first embodiment.

FIG. 3 is a partial cross-sectional view illustrating the condition in which the delivery channel 15 is closed in the first embodiment. In this description, the finger 44 is touched upon as an example. This explanation is made in conjunction with FIG. 1 as well. When the finger pressing surface 21*d* of the cam 20 reaches the position for pressing the finger 44, the elastic member 90 closes the delivery channel 15 in accordance with the press of the pressing portion 44*c* of the finger 44. When the engagement between the finger pressing surface 21*d* and the cam contact portion 44*b* is released with further rotation of the cam 20, the finger 44 is pushed back toward the cam 20 by the elastic force of the elastic member 90 to open the delivery channel 15 (condition shown in FIG. 2A).

The operation associated with the fluid transportation performed by the fluid transporter 1 is now explained with reference to FIGS. 1 through 3.

The cam 20 rotates the cam gear 76 by the operation of the driving device and the transmission mechanism which transmits the drive of the driving device to the cam 20 at a predetermined reduction ratio. The cam 20 combined with the cam gear 76 rotates in the direction indicated by the arrow R to push the finger 44 via the finger pressing surface 21*d*. In this case, the finger 44 closes the delivery channel 15 while deforming the elastic member 90.

The finger 45 contacting the connecting portion between the finger pressing surface 21*d* and the finger pressing slope 22 closes the delivery channel 15. The finger 46 disposed on the finger pressing slope 22 presses the elastic member 90 by a degree of press smaller than that of the finger 44, and therefore does not completely close the delivery channel 15.

The fingers 40 through 43 disposed in the range of the circular-arc-shaped portion 23 or the finger pressing slope 22 of the cam 20 are located at initial positions free from pressing.

With further rotation from this position in the direction of the arrow R, the cam 20 presses the fingers 45 and 46 in this order via the finger pressing surface 21*d* to close the delivery channel 15. In this case, the finger 44 is released from the finger pressing surface 21*d* to open the delivery channel 15. As a result, fluid flows into the delivery channel 15 toward the opened positions or positions not yet closed.

With further rotation of the cam 20, the finger pressing slope 22 sequentially presses the fingers 40, 41, 42, and 43 in this order from the upstream side to the downstream side of the fluid. These fingers 40 through 43 close the delivery channel 15 when reaching the finger pressing surface 21*c*.

Through these repetitive operations, the fluid can be transported from the reservoir 11 toward the outlet channel 18 and discharged therefrom.

According to this embodiment, the delivery channel 15 is defined by the groove 16 and the sheet-shaped elastic member 90 formed on the channel frame 14. The groove 16 is produced by injection molding or other methods with higher accuracy than that of the inside diameter of an elastic tube used in related art. Moreover, the sheet-shaped elastic member 90 has little effect on the dimensional variations of the delivery channel 15. Thus, the accuracy of the cross-sectional area of the delivery channel 15 increases, which contributes to reduction of the variations in the delivery amount of fluid caused by variations in the cross-sectional area of the delivery channel 15. Accordingly, the accuracy of the delivery amount of fluid improves.

Each of the pressing portions of the fingers 40 through 46 (pressing portion 44*c* is shown as an example) has the configuration similar to the shape of the groove 16 of the delivery channel 15 (channel wall 16*c* and slopes 16*a* and 16*b*). Thus, the elastic member 90 closely contacts the inner wall of the groove 16 in such a manner as to close the delivery channel 15 without a clearance produced thereat.

As illustrated in FIG. 1, the delivery channel 15 is formed on the outer circumferential side surface of the channel frame 14. In this case, the groove 16 can be produced with high accuracy by cutting or other methods when the channel frame 14 is shaped by injection molding. Moreover, the work for fixing the elastic member 90 can be facilitated.

The technical principle in this embodiment can be applied to a structure which includes a plurality of rollers in lieu of the plural fingers as in the disclosure of JP-A-2-280763. When the delivery channel is closed by the rollers, there is a possibility that the elastic member deforms in such a manner as to expand in the delivery direction of fluid (rotation direction of rotor). According to this embodiment, however, the elastic member is pressed by the fingers substantially in the vertical direction. Thus, such deformation of the elastic member can be avoided.

Modified Example of First Embodiment

A modified example of the first embodiment is hereinafter described with reference to the drawings. In this modified example, each of the pressing portions of the fingers 40 through 46 has a fringe for pressing the peripheral surface 16*d* of the groove 16 to which the elastic member 90 is fixed. The parts in this modified example which correspond to the same functions in the first embodiment (see FIG. 2B) have been given the same reference numbers, and the points which differ from the first embodiment will be discussed.

Figure 4:
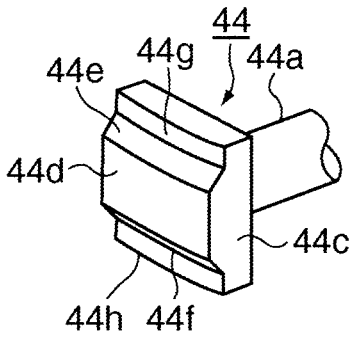
FIG. 4 is a partial perspective view showing a finger according to a modified example of the first embodiment.

FIG. 4 is a partial perspective view illustrating a finger according to the modified example of the first embodiment. In this description, the finger 44 included in the plural fingers is only touched upon as an example. The finger 44 has the pressing portion 44*c* at the end of the shaft portion 44*a*.

The pressing portion 44*c* has the pressing surface 44*d* disposed on the circle concentric with the channel wall 16*c*, and the slopes 44*e* and 44*f* having the same angles as those of the slopes 16*a* and 16*b*, respectively, and further has fringes 44*g* and 44*h* continuing to the slopes 44*e* and 44*f*, respectively. The pressing surface 44*d* and the slopes 16*a* and 16*b* have the same configurations as those in the first embodiment (see FIG. 2B).

The fringes 44*g* and 44*h* are provided in such a manner as to project and press at least a part of the peripheral surface 16*d* of the groove 16 to which the elastic member 90 is fixed. Thus, the shapes of the fringes 44*g* and 44*h* on the elastic member 90 side in the plan view are disposed on a circle concentric with the peripheral surface 16*d*.

In closing the delivery channel 15 by using any of the fingers 40 through 46, there is a possibility that the delivery channel 15 cannot be completely closed with an extremely small clearance left on the fixing boundary between the groove 16 and the elastic member 90. In this case, a predetermined delivery amount cannot be securely transported. According to the structure which includes the fringes 44*g* and 44*h* as in this modified example, however, the fixing boundary can be sufficiently closed, whereby the predetermined delivery amount can be transported with no clearance left on the fixing boundary. Moreover, the fixing strength of the elastic member 90 produced when the elastic member 90 is pressed can be increased.

Second Embodiment

A second embodiment is now described with reference to the drawings. In the second embodiment, the cross-sectional shape of the channel wall of the delivery channel in the direction perpendicular to the fluid flow direction is circular-arc-shaped. The parts in the second embodiment which correspond to the same functions in the first embodiment have been given the same reference numbers, and the points which differ from the first embodiment are chiefly touched upon. In this embodiment, the finger 44 is discussed as an example.

Figure 5A:
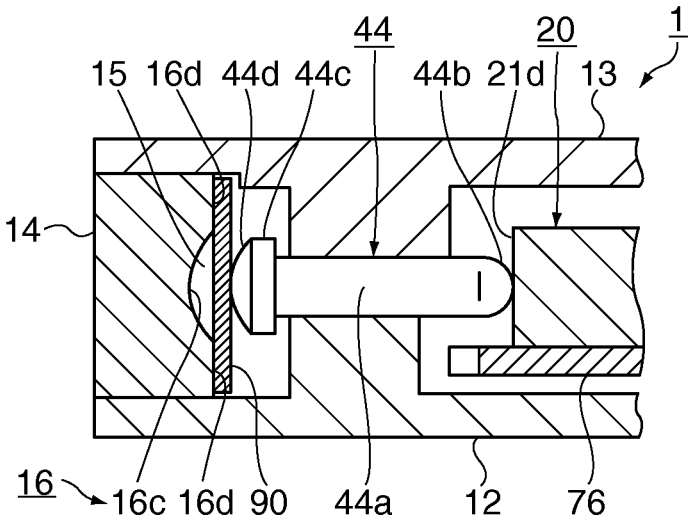
Figure 5B:
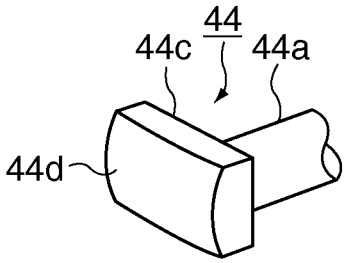

FIGS. 5A and 5B illustrate a fluid transporter in the second embodiment. FIG. 5A is a partial cross-sectional view showing a cross section taken along the line A-P1-A in FIG. 1, while FIG. 5B is a perspective view showing a part of the finger 44. As illustrated in FIGS. 5A and 5B, the delivery channel 15 is defined by the groove 16 formed in the channel frame 14 and the elastic member 90. The groove 16 is formed by the channel wall 16*c* having a circular-arc-shaped cross section.

The finger 44 has the bar-shaped shaft portion 44*a*, the pressing portion 44*c* formed on the elastic member 90 side of the shaft portion 44*a*, and the cam contact portion 44*b* formed on the cam 20 side of the shaft portion 44*a*. As illustrated in FIG. 5B, the pressing portion 44*c* is a substantially quadrangular fringe-shaped portion, and has the pressing surface 44*d* configured to follow the shape of the channel wall 16*c*. More specifically, the pressing surface 44*d* has a curved surface as a combination of the circular-arc shape of the circle concentric with the channel wall 16*c* in the plan view and the circular-arc shape of the cross section of the channel wall 16*c*.

When the cross-sectional shape of the delivery channel 15 is quadrangular or trapezoidal as in the first embodiment, corners are produced on the crossing portions of the sides forming the delivery channel 15 and on the fixing boundary between the delivery channel 15 and the elastic member 90. In closing the delivery channel 15 by the elastic member 90, there is a possibility that small clearances are formed on these corners. When the clearances are formed thereon, errors and variations of the fluid delivery amount are produced. According to this embodiment, however, if the channel wall 16*c* has the substantially circular-arc-shaped cross section, no corner is formed. Thus, the delivery channel 15 can be closed more securely, whereby the accurate fluid delivery amount can be maintained.

Modified Example of Second Embodiment

A modified example of the second embodiment is now described with reference to the drawings. This modified example is similar to the modified example of the first embodiment in that each of the pressing portions of the fingers 40 through 46 has a fringe for pressing the peripheral surface 16*d* of the groove 16 to which the elastic member 90 is fixed. Therefore, the parts in this modified example which correspond to the same functions in the second embodiment (see FIG. 5B) have been given the same reference numbers shown in FIG. 5B, and the points which differ from the second embodiment are touched upon.

Figure 6:
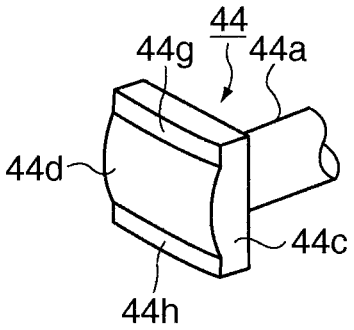
FIG. 6 is a partial perspective view of a finger according to a modified example of the second embodiment.

FIG. 6 is a partial perspective view illustrating the finger 44 according to the modified example of the second embodiment as an example of the plural fingers. The finger 44 has the pressing portion 44*c* at the end of the shaft portion 44*a*. The pressing portion 44*c* has the pressing surface 44*d* having a same shape as the corresponding shape in the second embodiment, and the fringes 44*g* and 44*h* continuing to the pressing surface 44*d*.

The fringes 44*g* and 44*h* are provided in such a manner as to project and press at least apart of the peripheral surface 16*d* of the groove 16 to which the elastic member 90 is fixed (see FIG. 5A). Thus, the shapes of the fringes 44*g* and 44*h* in the plan view are disposed on a circle concentric with the peripheral surface 16*d*.

According to this structure, the fluid transporter 1 provides both the advantage of elimination of the corners as in the second embodiment and the advantage of provision of the fringes 44*g* and 44*h* as in the modified example of the first embodiment.

In addition, the substantially circular-arc-shaped channel wall 16*c* as a part having a simplified configuration can be easily manufactured. Accordingly, the dimensional accuracy improves.

Third Embodiment

A third embodiment is now described with reference to the drawings. In the third embodiment, the groove and the elastic member formed on the channel frame of the delivery channel are substantially symmetric with respect to the peripheral surface of the groove unlike the first embodiment and the second embodiment where the sheet-shaped elastic member is provided on the delivery channel. Thus, the points which differ from the first and second embodiments are touched upon in the following description.

Figure 7:
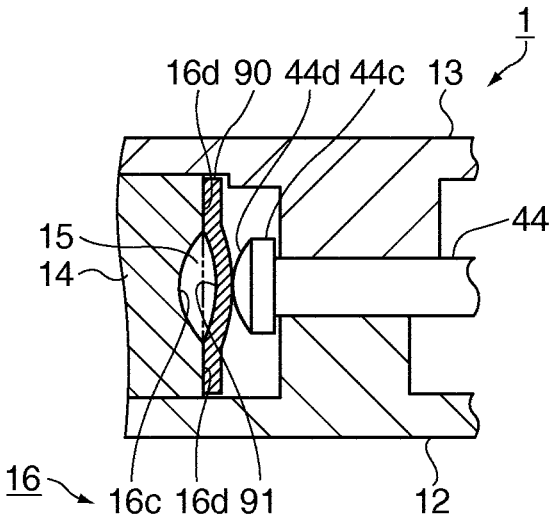
FIG. 7 is a partial cross-sectional view showing a delivery channel according to a third embodiment.

FIG. 7 is a partial cross-sectional view illustrating the delivery channel according to the third embodiment. The delivery channel 15 is defined by the groove 16 formed in the channel frame 14 and provided with the channel wall 16*c* having a circular-arc-shaped cross section, and a recess 91 formed in the elastic member 90. The recess 91 can be formed in the sheet-shaped elastic member 90 by heat press molding, injection molding or other methods. The channel wall 16*c* of the channel frame 14 and the recess 91 of the elastic member 90 are substantially symmetric with respect to the peripheral surface 16*d* of the groove 16.

FIG. 7 illustrates the finger 44 in the second embodiment as an example of the finger closing the delivery channel 15 thus constructed. The cross-sectional shape of the pressing surface 44*d* of the pressing portion 44*c* is defined by a curved surface configured to follow the channel wall 16*c*.

When the finger 44 presses the elastic member 90, the surface of the recess 91 closely contacts the channel wall 16*c* to close the delivery channel 15.

While the cross-sectional shape of the pressing surface 44*d* shown in FIG. 7 is a circular-arc shape (curved surface) as in the second embodiment, this shape may be a trapezoidal shape as in the first embodiment. It is more preferable that the fringes 44*g* and 44*h* as in the respective modified examples of the first and second embodiments are provided in this embodiment.

According to the structure in the third embodiment, the delivery channel 15 is defined by the cross-sectional shape of the channel wall 16*c* and the recess 91 of the elastic member 90 as substantially symmetric portions. When the elastic member 90 is a simple sheet-shaped component, the fingers press the elastic member 90 in such a manner as to expand the elastic member 90 at the time of closure of the delivery channel 15. In this case, the pressing force applied to the elastic member 90 increases. When the recess 91 is formed on the elastic member 90, however, the amount of expansion of the elastic member 90 at the time of closure decreases. In this case, the delivery channel 15 can be securely closed only by small pressing forces of the fingers 40 through 46. Moreover, the durability of the elastic member 90 improves.

Fourth Embodiment

A fourth embodiment is herein described with reference to the drawings. In the fourth embodiment, the inlet channel 17 and the outlet channel 18 communicate with the delivery channel 15 in directions substantially perpendicular to the delivery channel 15 unlike the first embodiment where the inlet channel 17 and the outlet channel 18 communicate with the delivery channel 15 in the extending direction of the delivery channel 15. The parts in the fourth embodiment which correspond to the same functions in the first embodiment have been given the same reference numbers, and the points which differ from the first embodiment are chiefly touched upon.

Figure 8:
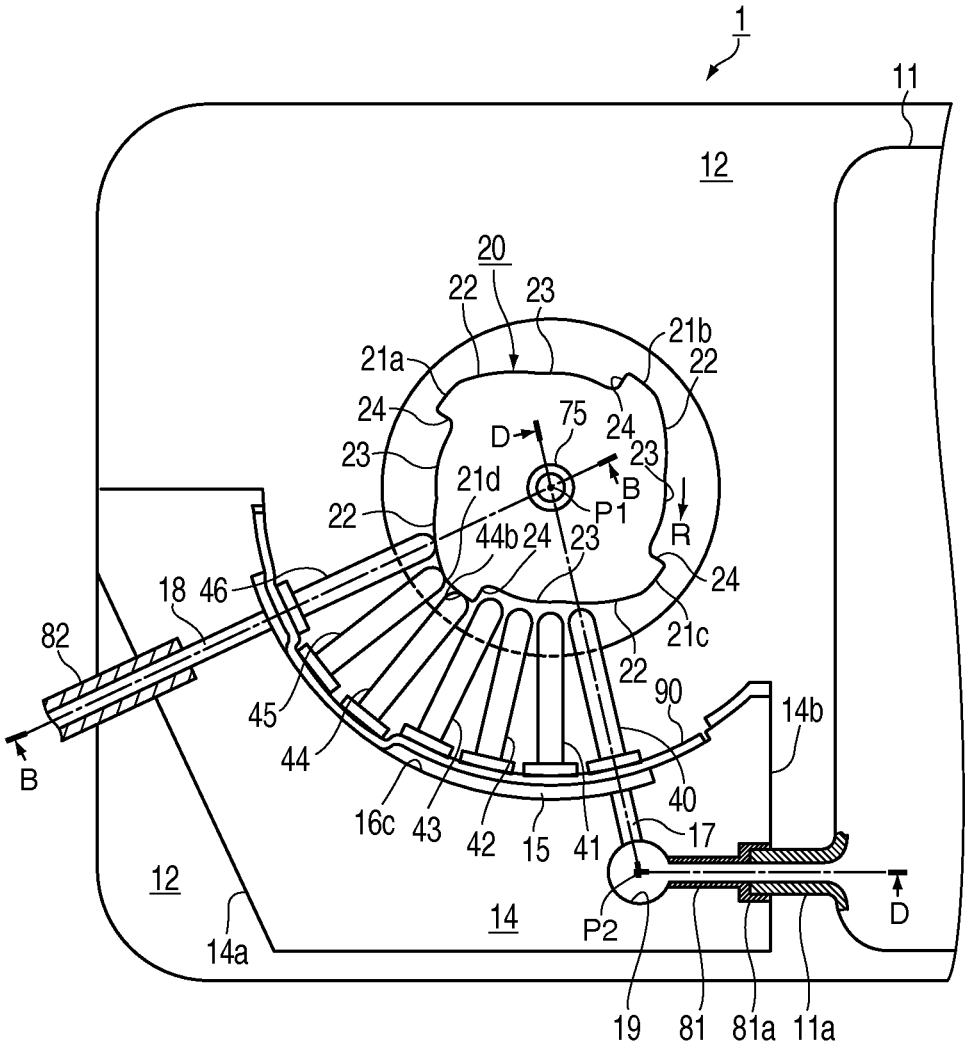
FIG. 8 is a plan view illustrating a fluid transporter according to a fourth embodiment.
Figure 9:
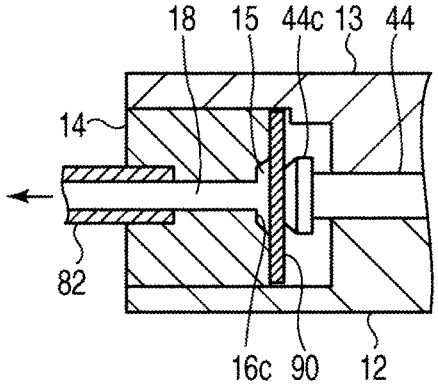
FIG. 9 is a cross-sectional view showing a cross section taken along a line B-P1-B in FIG. 8.
Figure 10:
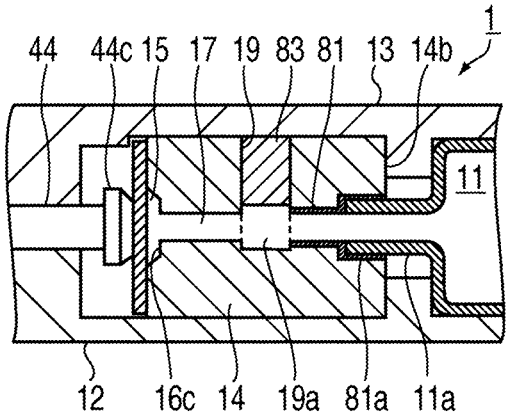
FIG. 10 is a cross-sectional view showing a cross section taken along a line D-P2-D in FIG. 8.

FIG. 8 is a plan view illustrating a fluid transporter according to the fourth embodiment. FIG. 9 is a cross-sectional view illustrating a cross section taken along a line B-P1-B in FIG. 8. FIG. 10 is a cross-sectional view illustrating a cross section taken along a line D-P2-D in FIG. 8. The delivery channel 15 and the fingers 40 through 46 are those employed in the first embodiment, for example. As illustrated in FIGS. 8 and 9, the inlet channel 17 communicates with the delivery channel 15 via a hole penetrating the channel wall 16*c* and with a fluid retainer 19*a* at positions in the extending direction of the finger 40 located at the upstream end of the delivery channel 15.

The fluid retainer 19*a* communicates with the reservoir 11 via the connection tube 81. The fluid retainer 19*a* is produced by a hole 19 opened from above the inlet channel 17 in the vertical direction and sealed by a sealing member 83 without decrease in the cross-sectional area of the inlet channel 17.

The connection tube 81 has a dual-step structure which has a small-diameter portion connected with the fluid retainer 19*a* and a large-diameter portion. A connection portion 11*a* projecting from the reservoir 11 is connected with a connection portion 81*a* between the large-diameter portion of the connection tube 81 and the reservoir 11. This structure permits communication between the reservoir 11 and the delivery channel 15. The connection tube 81 is inserted in a direction substantially perpendicular to a side wall 14*b* of the channel frame 14.

The opening position of the inlet channel 17 is not limited to the position shown in the figure but may be arbitrarily determined as long as the position is located on the delivery channel 15 on the side upstream from the finger 40.

The structure of the outlet channel 18 is now explained. As illustrated in FIGS. 8 and 10, the outlet channel 18 is produced by a hole penetrating the channel wall 16*c* in the extending direction of the finger 46 located at the downstream end of the delivery channel 15. The outlet channel 18 is a hole opened in a direction substantially perpendicular to an outer circumferential side wall 14*a* of the channel frame 14, and extended to the outside while inserted into the connection tube 82.

The connection tube 82 may be constructed similarly to the inlet channel side connection tube 81 and directly connected with the delivery channel 15. The opening position of the outlet channel 18 is not limited to the position shown in the figure but may be arbitrarily determined as long as the position is located on the delivery channel 15 on the side downstream from the finger 46.

According to this embodiment, the delivery channel 15 including the elastic member 90 on the channel frame 14, the inlet channel 17 including the connection tube 81, and the outlet channel 18 including the connection tube 82 as components combined into a unit to which the reservoir 11 is connected.

In this case, the inlet channel 17 and the outlet channel 18 formed as holes in the channel frame 14 have simplified structure. Moreover, when the fluid to be transported is a liquid medicine injected into a living body, the channel frame unit constituted by the delivery channel 15, the inlet channel 17, and the outlet channel 18 formed in the channel frame 14 as a unit in contact with the liquid medicine can be replaced with a new unit for increasing safety. Furthermore, the running costs decrease when the other components are repeatedly used.

Fifth Embodiment

A fluid transporter according to a fifth embodiment is now described with reference to the drawings. In the fifth embodiment relating to the structure of the fingers, each pressing portion of the fingers for pressing the elastic member has elasticity.

Figure 11A:
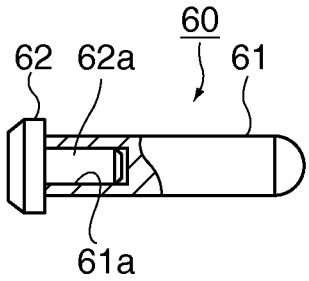
Figure 11B:
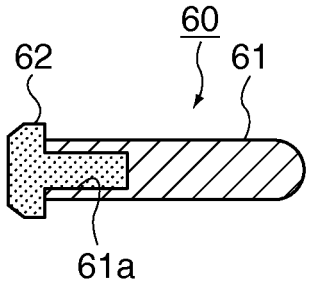

FIGS. 11A and 11B are front views illustrating a finger according to the fifth embodiment. FIG. 11A shows an example 1, while FIG. 11B shows an example 2.

Initially, the example 1 in this embodiment is explained. In this description, a finger 60 as one of seven fingers having the same configuration is discussed as an example. The finger 60 has a shaft portion 61 and a fringe-shaped pressing portion 62. The pressing portion 62 is made of elastic material. A shaft section 62*a* is inserted into a hole 61*a* formed at one end of the shaft portion 61.

The shaft portion 61 is rigid to such an extent as not to be deformed when the delivery channel 15 is closed by the cam 20. It is preferable that the pressing portion 62 is elastic to such an extent as to follow the shape of the channel wall 16*c* when the delivery channel 15 is closed.

The example 2 in this embodiment is now explained. In this example, the finger 60 has the shaft portion 61 and the fringe-shaped pressing portion 62 as two types of molded components. The pressing portion 62 is made of elastic material. The shaft portion 61 is rigid to such an extent as not to be deformed when the delivery channel 15 is closed by the cam 20.

According to the examples 1 and 2, the pressing portion 62 of the finger 60 has elasticity. Thus, the shape of the pressing portion 62 can easily follow the shapes of the channel wall 16*c* and the slopes 16*a* and 16*b* of the delivery channel 15 at the time of closure of the delivery channel 15. Accordingly, the delivery channel 15 can be more securely closed.

Moreover, the elasticity of the pressing portion 62 absorbs dimensional variations of the delivery channel 15 and of the fingers including those of the cam 20, and thus prevents stop of the drive due to excessive loads produced by the dimensional variations.

It is to be noted that the structures shown in FIGS. 11A and 11B in the examples 1 and 2 as instances applied to the first embodiment are applicable to the second embodiment and the respective modified examples as well.

In the first through the fifth embodiments, the fluid transporter 1 which transports fluid by the peristaltic movement of the fingers 40 through 46 produced by pressing the elastic member 90 provided on the delivery channel 15 by using the cam 20 as a rotor and the fingers 40 through 46 as pressing members has been discussed as an example. However, the teachings of the respective embodiments are applicable to a structure which delivers liquid by pressing a tube from the upstream side to the downstream side by using a plurality of rollers attached to a rotor as in the structure disclosed in JP-A-2-280763.

In case of the structure shown in JP-A-2-280763, a pressing portion so configured as to follow the shape of the delivery channel is provided on each of the rotational side surfaces of the plural rollers.

Accordingly, the fluid transporter 1 in the first through the fifth embodiments as a small-sized device having a reduced thickness can successively transport a small amount of fluid at low speed. Thus, the fluid transporter 1 is suited for applications for medical purposes such as development of new medicines and drug delivery when inserted into a living body or attached onto the surface of the living body. Alternatively, the fluid transporter 1 can be employed for transportation of fluid such as water, salt water, liquid medicines, oils, aromatic liquids, ink, and gases when placed inside or outside various types of apparatus.

The entire disclosure of Japanese Patent Application No. 2010-131740, filed Jun. 9, 2010 is expressly incorporated by reference herein.

What is claimed is:

1. A fluid transporter comprising:

a rotor having an outer peripheral circumferential surface;

a fluid delivery channel which has a groove, the groove having a circular-arc shape on a concentric circle around a rotation axis of the rotor, the concentric circle having a diameter larger than a periphery of the rotor;

a sheet-shaped member attaching to and fluidly sealing the groove; and a plurality of pressing members disposed between the outer peripheral circumferential surface of the rotor and the sheet-shaped member and selectively engageable by the outer peripheral circumferential surface of the rotor;

wherein the plurality of pressing members contact and deform the sheet-shaped member in accordance with the rotation of the rotor; wherein an elastic force of the sheet-shaped member shifting the plurality of pressing members towards a rotation axis of the rotor upon disengagement of the plurality of pressing members from the rotor.

2. The fluid transporter according to claim 1, further comprising:

pressing portion provided on each of the plural pressing members is configured to press the sheet-shaped member, wherein each of the pressing portions has a shape similar to the cross-sectional shape of the groove in the direction perpendicular to the fluid flowing direction.

3. The fluid transporter according to claim 2, wherein each of the pressing portions has a fringe portion which presses the peripheral surface of the groove to which the elastic member is fixed.

4. The fluid transporter according to claim 1, wherein the cross-sectional shape of a channel wall of the groove in the direction perpendicular to the fluid flowing direction is a circular-arc shape.

5. The fluid transporter according to claim 1, wherein the delivery channel is so shaped that the groove and the elastic member become symmetric with respect to the peripheral surface of the groove to which the elastic member is fixed.

6. The fluid transporter according to claim 1, wherein the delivery channel is provided on an outer circumferential side surface of a channel frame.

7. The fluid transporter according to claim 1, wherein a channel frame has the delivery channel, and a fluid inlet channel and a fluid outlet channel penetrating the channel wall of the groove;

the inlet channel is disposed on the upstream part of the delivery channel; and the outlet channel is disposed on the downstream part of the delivery channel.

8. The fluid transporter according to claim 1, wherein the rotor is a cam; and the plural pressing members are fingers radially disposed in directions from the rotation axis of the cam and pressed by the cam.

9. The fluid transporter according to claim 1, wherein the sheet-shaped member is configured to selectively shift the plurality of pressing members towards the rotor in accordance with rotation of the rotor.

* * * * *